United States Patent [19]

Barbeau

[11] 4,022,542

[45] May 10, 1977

[54] TURBINE BLADE

[75] Inventor: Dennis E. Barbeau, Temperance, Mich.

[73] Assignee: Teledyne Industries, Inc., Los Angeles, Calif.

[22] Filed: Oct. 23, 1974

[21] Appl. No.: 517,143

[52] U.S. Cl. ..... 416/97 A; 416/231 R

[51] Int. Cl.[2] ..... F01D 5/18

[58] Field of Search ..... 29/156.8 R, 156.8 B, 29/156.8 H, 156.8 T; 415/DIG. 1, 114, 115; 416/97, 229, 231, 90, 95–97 A; 60/20 A

[56] References Cited

UNITED STATES PATENTS

| | | | |
|---|---|---|---|
| 2,755,061 | 7/1956 | Jackson | 416/90 |
| 2,825,532 | 3/1958 | Kadosch et al. | 415/DIG. 1 |
| 2,873,944 | 2/1959 | Wiese et al. | 416/97 |
| 2,920,866 | 1/1960 | Spurrier | 416/96 A X |
| 3,067,982 | 12/1962 | Wheeler | 416/231 X |
| 3,240,468 | 3/1966 | Watts et al. | 416/97 |
| 3,385,509 | 5/1968 | Garnier | 415/DIG. 1 |
| 3,402,914 | 9/1968 | Kump et al. | 415/115 |
| 3,433,015 | 3/1969 | Sneeden | 416/90 |
| 3,560,107 | 2/1971 | Helms | 416/229 A X |
| 3,567,333 | 3/1971 | DeFeo | 416/97 X |
| 3,584,972 | 6/1971 | Meginnis et al. | 416/229 |
| 3,606,572 | 9/1971 | Schwedland | 416/97 X |
| 3,644,059 | 2/1972 | Bryan | 416/97 |
| 3,644,060 | 2/1972 | Bryan | 416/97 |
| 3,647,316 | 3/1972 | Moskowitz | 416/97 |
| 3,700,418 | 10/1972 | Mayeda | 416/231 X |
| 3,726,604 | 4/1973 | Helms et al. | 415/115 |
| 3,732,031 | 5/1973 | Bowling et al. | 416/97 |

FOREIGN PATENTS OR APPLICATIONS

| | | | |
|---|---|---|---|
| 1,263,010 | 4/1961 | France | 416/97 |

*Primary Examiner*—Everette A. Powell, Jr.
*Attorney, Agent, or Firm*—Gifford, Chandler, Sheridan & Sprinkle

[57] ABSTRACT

An improved transpiration cooled turbine blade has a porous wall for the passage of coolant fluid therethrough; the wall comprising an outer porous layer, a second layer with relatively large holes, and a third layer with metering holes for the cooling fluid. There is provision for the direct passage of coolant to the edges of the blade, which edges are single layered. Slots near the trailing edge of the blade direct a portion of the cooling fluid outwardly at a right angle to the blade's concave surface to reduce drag losses due to flow separation under conditions of high blade loading.

17 Claims, 8 Drawing Figures

TURBINE BLADE

BACKGROUND OF THE INVENTION

I. Field of the Invention

The present invention relates to turbine blades and, more particularly, to transpiration cooled turbine blades.

II. Description of the Prior Art

Presently known transpiration cooled turbine blades are formed with a porous wall defining a hollow interior. U.S. Pat. No. 3,619,082 (Meginnes) and U.S. Pat. No. 3,647,316 (Moskowitz) provide examples of such blades. The porous wall is formed of a plurality of layers bonded together so that the pores or holes in adjacent layers may be out of registration in order to provide for lateral movement of coolant fluid, as well as providing for the movement of such fluid from the interior of the blade to the surface. The coolant fluid is usually compressed air which enters from the blade base.

However, the presence of the various layers in the blades of the art can tend to restrict the rate of flow of coolant through the wall and the rate of passage of coolant to the edges of the blade. This prevents adequate and controlled cooling of the edges and surfaces and leads to stresses because of temperature differences from one part of the blade to another. Furthermore, when highly loaded, these blades may have a relatively high performance loss because the stream line over the low pressure exterior surface of the blade tends to separate from the surface of the blade to form eddy currents near the trailing edge of the blade. This reduces the power derived from each such blade.

There is therefore a need for a lightweight, relatively inexpensive transpiration cooled turbine blade, wherein loadings may be high without attendant performance losses and cooling of the blade edges and surface is effective and uniform.

SUMMARY OF THE INVENTION

The present invention is a transpiration cooled turbine blade formed of a porous wall defining a hollow interior wherein a coolant fluid, such as compressed air, is received into said interior through the blade base. The porous wall is formed of at least three porous layers, the pores or holes in adjacent layers being in registration.

In a preferred embodiment of the invention the innermost of three layers is provided with holes which meter the flow of coolant fluid through the blade wall. Each such metering hole is in registration with a hole in the intermediate layer which is constructed in the form of a grid, the holes in the intermediate layer having larger cross sectional areas, respectively, than the metering holes. The outer layer, or skin, is formed of very small holes or pores.

The coolant fluid entering the blade through its base passes into the blade interior, then through the metering holes into the relatively larger holes of the intermediate area, and then through the porous skin to the blade surface. The total cross sectional area of the holes in the intermediate layer contacts a major proportion of the area of the outer layer with which the intermediate area is coextensive to provide a minimum of obstruction to the flow of coolant fluid to the outer layer.

The distribution of metering holes, together with the holes in the intermediate layer in register therewith, can be varied over the area of the layers in order to provide for temperature equalization over the blade surface. Additional layers, particularly for strengthening the blade, can be used. These are normally positioned inwardly of the three layers already described and, when used, are provided with holes in register with the metering holes and with the holes of the intermediate layer.

It is a feature of the invention to further equalize the temperature over the blade surface by providing for direct contact of the coolant fluid with the outer layer of the blade near the edges; that is, the leading edge, and the trailing edge. This is accomplished by limiting the area covered by the inner wall layers. To this end the area covered by the inner layers terminates short of the areas near each of the edges and, preferably, each inner layer terminates farther from said edges than the next contiguous, more outwardly positioned layer.

Another important feature of the invention is to use the coolant fluid to reduce losses due to flow separation near the trailing edge of the blade under conditions of high blade loading. This is accomplished by providing a bleed slot, or plurality of bleed slots, in the concave surface of the outer layer near the trailing edge and outside the area covered by the inner layers. Preferably, the bleed slots, are positioned near the blade base. Coolant fluid flows through the bleed slot and then outwardly from the concave surface at substantially a right angle to deflect the airstream passing along the blade's concave surface in a manner to reduce eddy currents at the point where the airstreams from the concave and convex sides of the blade join.

Another feature of the invention is to substitute radial strips of solid material for the porous outer skin, diffusion bonded to the next contiguous inner layer to form a contiguous outer skin. This will combine film with transpiration cooling to reduce aerodynamic losses associated with transpiration cooling. The location of strips can be made selectively in areas of highest loss. For example, a strip at the trailing edge suction surface will reduce the trailing edge wake, thus reducing losses in downstream blade rows.

An alternative to the above is to increase the axial width of solid material on the intermediate layer, thus to block flow in the transpiration made to sections radially located on the blade. These sections will be protected by film cooling using air spent through the transpiration strips on the blade.

BRIEF DESCRIPTION OF THE DRAWINGS

A better understanding of the invention will be achieved upon reference to the accompanying specification and by reference to the following drawings wherein like numerals refer to like parts throughout the several views, and in which.

DETAILED DESCRIPTION OF THE PREFERRED EMBODIMENT

Figure 1:
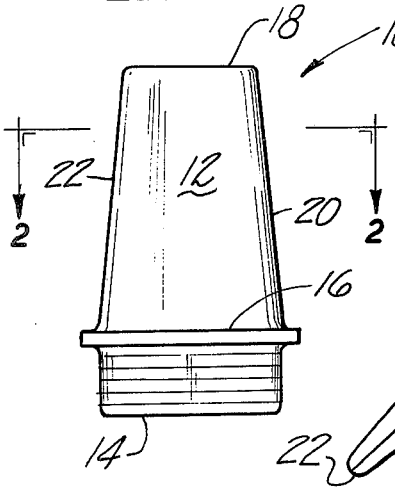
FIG. 1 is a perspective view of an embodiment of the transpiration cooled turbine blade of the invention.

FIG. 1 shows a transpiration cooled turbine blade assembly 10 having a turbine blade 12 attached to and extending from a mounting 14. The mounting 14 is used for attaching the blade to a turbine disc (not shown). As can be best seen in FIGS. 1, 2 and 3, the blade 12 is basically a twisted air foil and is tapered from its base 16 to its tip 18. The blade has a generally radiused leading edge 20, a relatively sharp trailing edge 22, a concave high pressure surface 24 and a convex low pressure surface 26. The blade walls are spaced apart defining a hollow interior 28.

Figure 2:
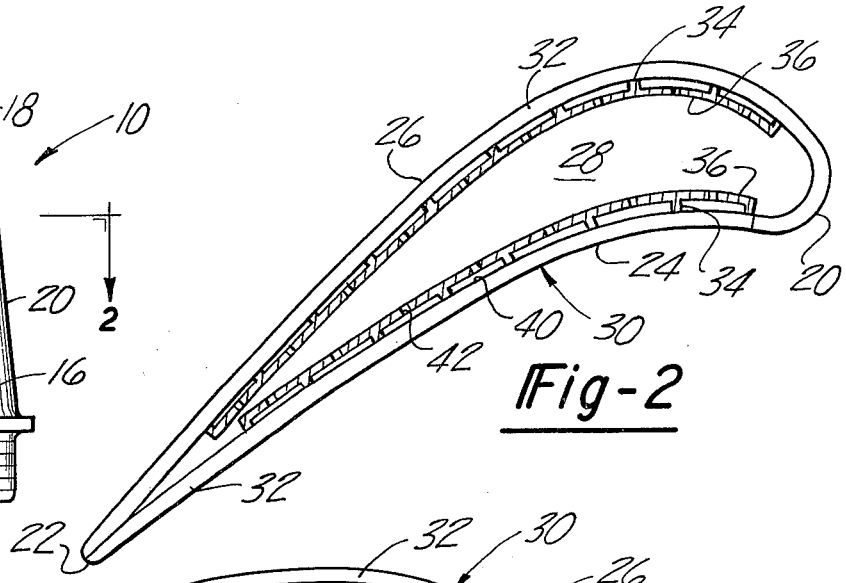
FIG. 2 is a view taken along line 2—2 of FIG. 1.

In the embodiment of the invention shown in FIG. 2, the blade 12 is formed of a wall, indicated generally as 30, comprised of three porous layers; an outer layer 32, intermediate layer 34 and an inner layer 36. The outer layer 32, by way of example, consists of five laminates of GE 1541 wire mesh diffusion bonded together, forming a plurality of small pores 38 (see FIG. 4). The intermediate layer 34 consists of a grid of laminated metal sheets diffusion bonded together and forming a plurality of air spaces such as air space or plenum 40. The inner layer 36 consists of, for example, two sheets of INCO 718 sheet diffusion bonded together and photoetched to provide metering holes 42. The layers 32, 34 and 36 are diffusion bonded together to form the wall 30.

Figure 3:
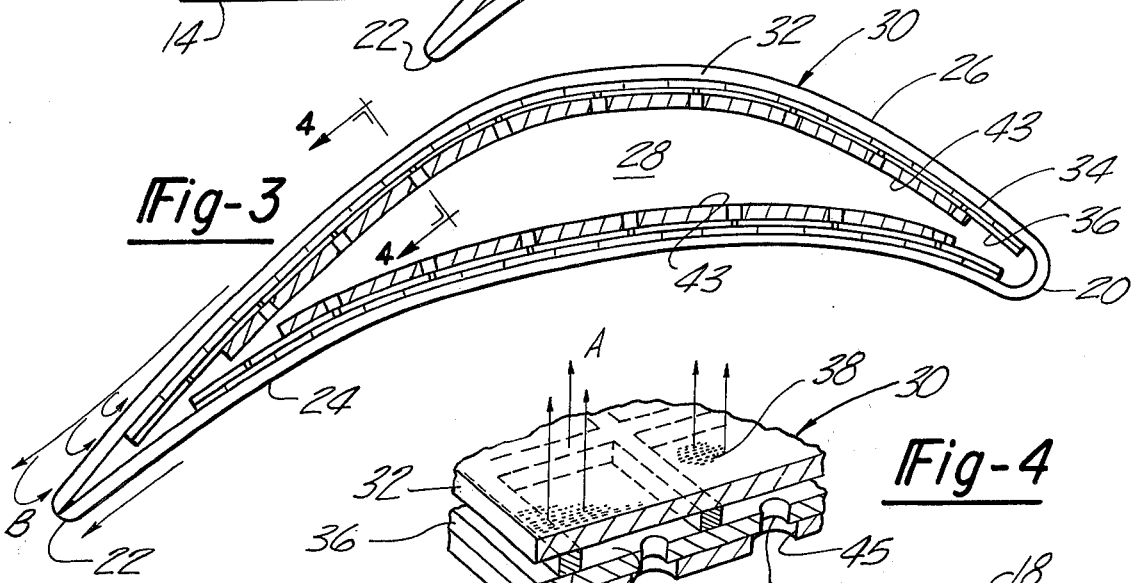
FIG. 3 is an elevation view, in cross section, of a second embodiment of the invention.

An important feature of the invention can be best seen in FIGS. 2 and 3, wherein, as shown, the intermediate layer 34 and inner layer 36 terminate short of the leading and trailing edges to allow a flow of cooling fluid directly to the inner surface of the outer layer 32 to provide a more effective cooling in these areas. The pores 38 register with the rectangular holes 40 of the layer 34 and the metering holes 42 also register with the rectangular holes 40. Preferably, one metering hole 42 registers with one rectangular hole 40.

Figure 4:
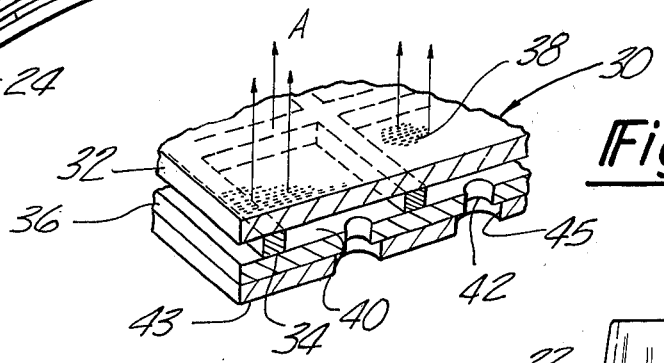
FIG. 4 is a perspective view of the wall construction of the turbine blade taken along line 4—4 of FIG. 3.

Thus, cooling fluid passes from the interior 28 through the metering holes 42 of the inner layer 36 into the rectangular holes 40 of the intermediate layer 34, and then through the pores 38 to the outside surface of the blade (see arrows A in FIG. 4). While each of the three layers 32, 34 and 36 provides structural support for the blade 12, the primary structural support in the rotor blade of FIG. 2 is provided by the inner layer 36.

In the embodiment of the invention shown in FIG. 3, a reinforcing plate 43, continguous with inner layer 36, is used to add additional support, the plate 43 being provided with holes 45 in register with metering holes 42. As shown in FIG. 3 it is preferred that the reinforcing plate 43 is shorter than the inner layer 36 in order to avoid blocking the passage of cooling fluid to the edges 20, 22. Similarly, additional layers, in addition to layer 43, may be used, each preferably terminating a farther distance from the edges 20, 22 than its next contiguous outer layer.

Figure 5:
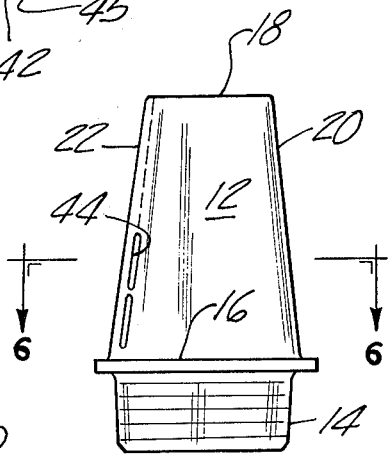
FIG. 5 is an elevation view, in cross section, of a third embodiment of a transpiration cooled turbine blade of the invention.
Figure 6:
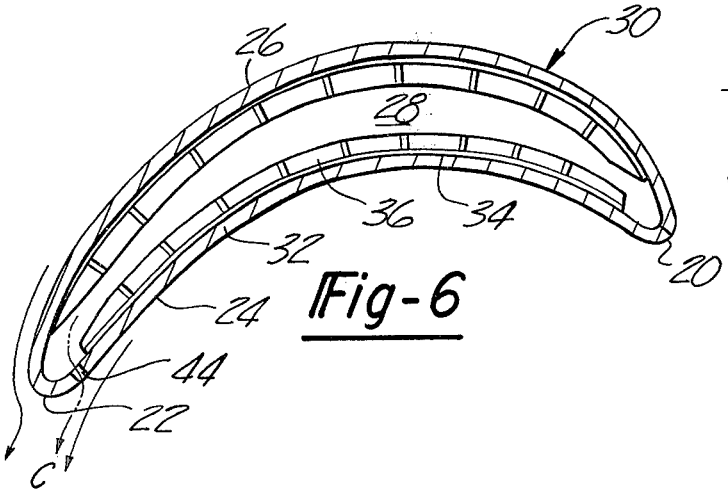
FIG. 6 is a view taken along line 6—6 of FIG. 5.

As a gas stream passes over the surface 26, it tends to separate from the surface 26 proximate the trailing edge 22 causing eddy currents to form at the trailing edge, resulting in a performance loss. This occurrence is illustrated by flow arrows B in FIG. 3. Referring to FIGS. 5 and 6, which show another embodiment of the invention, a plurality of elongated bleed slots 44 are formed through the outer layer 32 near the trailing edge 22 on the concave surface 24 to reduce this loss. Preferably, the slots 44 are formed proximate the base 16 of the blade near the trailing edge 22 and have their longitudinal axes disposed generally parallel to the trailing edge 22. These slots are formed to direct at least a portion of the cooling fluid flow from the interior 28 outwardly of the blade at substantially a right angle to the concave surface 24 and, thus, at a right angle to the stream line along the surface 24. The stream line over the blade is indicated by flow arrows C in FIG. 6. The flow of cooling fluid outwardly at right angles from the concave surface 24 appears to deflect outwardly the stream line along surface 24 sufficiently to effect the retardation of the separation of the stream line along the convex surface 26. This effects a reduction in eddy currents and in performance losses and reduces the number of turbine blades required to produce the same amount of work as produced by a turbine having blades without slots such as slots 44.

Figure 7:
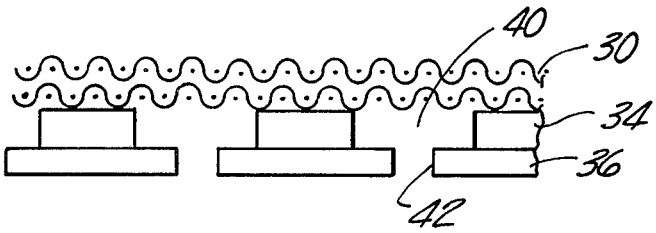
FIG. 7 is a cross-sectional view similar to FIG. 3 and illustrating a section of blade wherein there is relatively less transpiration cooling and relatively more film cooling.
Figure 8:
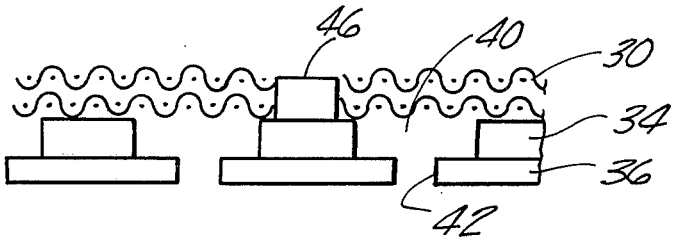
FIG. 8 is a cross sectional view of an embodiment of the invention wherein solid radial strips are positioned in the blade's outer skin.

In the embodiments of the inventions shown in FIGS. 7 and 8 provision is made for reducing aerodynamic losses due to transpiration cooling by selectively increasing film cooling relative to transpiration cooling in areas of highest loss. FIG. 7 shows an outer blade layer 30, an intermediate layer 34, and an inner layer 36 wherein the area covered by the solid material in the intermediate layer 34 is relatively larger and the area of the open space 40 is relatively smaller than that shown in the embodiment of FIG. 3. Thus, as shown in FIG. 7 the area of the outer layer marked D is cooled by the film of air moving horizontally across the area D whereas the area marked E is cooled by transpirated air passing through the blade wall.

FIG. 8 shows; in addition to layers 30, 34 and 36; a solid strip 46 extending radially and diffusion bonded to the layer 34. Such strips may be selectively positioned to decrease the area available for transpiration and increase the area subject to film cooling.

The transpiration cooled turbine blade 12 is relatively inexpensive to manufacture, is light, and achieves a high turbine rotor efficiency.

The foregoing detailed description is given primarily for clarity of understanding and no unnecessary limitations should be understood therefrom, for modifications will be obvious to those skilled in the art upon reading this disclosure and may be made without departing from the spirit of the invention or the scope of the appended claims.

I claim:

1. In a transpiration cooled turbine blade having a base, a tip, a concave surface, a convex surface, a leading edge, a trailing edge, a hollow interior adapted to receive coolant fluid therein, and a porous wall adapted to conduct said fluid from said interior to the surfaces of said blade, the improvement which comprises:

a. a porous outer layer in said wall defining the outer surface of said blade and extending from said leading edge to said trailing edge;

b. a second layer in said wall positioned inwardly of said outer layer, said second layer being provided with a plurality of holes;

c. a third layer in said wall positioned inwardly of said second layer, said third layer being provided with a plurality of holes which meter the distribution of fluid over the area of said second layer and over the area of said outer layer which is coextensive with said second layer;

d. said holes in said third layer registering respectively with said holes in said second layer;

e. said outer layer, said second layer and said third layer forming said hollow interior to be unobstructed, continuous and to conform substantially to the shape of the outer surface of said blade; and f. the area of said outer layer by said second and third layers terminates short of the areas near said edges in a manner to permit substantially direct contact of said fluid in said interior with said outer layer at said edges.

2. The turbine blade as defined in claim 1 wherein said third layer is positioned inwardly of said second layer.

3. The turbine blade as defined in claim 1 wherein there is a plurality of inner layers each of which terminates farther from said edges that the next contiguous, more outwardly positioned layer.

4. The turbine blade as defined in claim 2 wherein the holes in said second layer have, respectively, larger cross sectional areas than said metering holes and have a total cross sectional area which contacts a major proportion of the area of said outer layer coextensive with said second layer.

5. The turbine blade as defined in claim 1 and comprising a bleed slot in said blade on the concave side thereof and in the area of said trailing edge not covered by said inner layers, said bleed slot being adapted to direct a stream of said fluid outwardly at substantially a right angle to said concave surface.

6. The turbine blade as defined in claim 5 wherein said bleed slot is positioned near said blade base.

7. The turbine blade as defined in claim 6 wherein there is a plurality of said bleed slots.

8. The turbine blade as defined in claim 1 and comprising a bleed slot in said blade on the concave side near said blade base and in the area of said trailing edge not covered by said inner layers, said bleed slot being adapted to direct a stream of said fluid outwardly at substantially a right angle to said concave surface;

wherein said third layer is positioned inwardly of said second layer; and wherein the holes in said second layer have, respectively, larger cross sectional areas than said metering holes and have a total cross sectional area which contacts a major proportion of the area of said outer layer coextensive with said second layer.

9. The turbine blade as defined in claim 8 wherein there is a plurality of inner layers each of which terminates farther from said edges than the next contiguous, more outwardly positioned layer.

10. The turbine blade as defined in claim 8 wherein there is a plurality of said bleed slots.

11. The turbine blade as defined in claim 8 wherein the area of said outer layer covered by said inner layers terminates short of the area near said tip.

12. The turbine blade as defined in claim 11 wherein there is a plurality of said inner layers of which terminates farther from said tip then the next contiguous, more outwardly positioned layer.

13. The turbine blade as defined in claim 4 wherein said total cross sectional area of said holes in said second layer relative to said area of said outer layer is such as to provide both film cooling and transpiration cooling of said blade.

14. The turbine blade as defined in claim 1 and including a solid radially positioned strip positioned in said outer layer in a manner to selectively control the relative degree of film cooling and transpiration cooling in an area of said blade.

15. The turbine blade as defined in claim 8 and including a solid radially positioned strip positioned in said outer layer in a manner to selectively control the relative degree of film cooling and transpiration cooling in an area of said blade.

16. The turbine blade as defined in claim 12 and wherein there is a plurality of said bleed slots.

17. A transpiration cooled blade having a trailing edge and a leading edge and comprising a wall defining an interior chamber, said wall consisting of a porous outer layer extending from said leading edge to said trailing edge, a second layer being provided with a plurality of holes and being positioned inwardly of said outer layer and a third layer positioned inwardly of said second layer and provided with a plurality of metering holes to meter the distribution of fluid to said second layer and said outer layer, the interior chamber defined by said wall being unobstructed from the leading edge of said blade to the trailing edge thereof and being substantially concentric in cross-sectional shape to the cross-sectional shape of said blade, said second and third layers having edges terminating short of the trailing edge and the leading edge of said blade to expose the outer layer directly to the interior of said blade in the area of the leading and trailing edges.

* * * * *